US009347190B2

(12) United States Patent
Mattia

(10) Patent No.: US 9,347,190 B2
(45) Date of Patent: May 24, 2016

(54) SAFETY CONE AND METHOD OF MAKING THE SAME

(71) Applicant: Nick Matthew Mattia, Loomis, CA (US)

(72) Inventor: Nick Matthew Mattia, Loomis, CA (US)

( * ) Notice: Subject to any disclaimer, the term of this patent is extended or adjusted under 35 U.S.C. 154(b) by 188 days.

(21) Appl. No.: 14/066,956

(22) Filed: Oct. 30, 2013

(65) Prior Publication Data

US 2014/0118828 A1 May 1, 2014

Related U.S. Application Data

(60) Provisional application No. 61/720,057, filed on Oct. 30, 2012.

(51) Int. Cl.
*E01F 9/012* (2006.01)

(52) U.S. Cl.
CPC ..... *E01F 9/0122* (2013.01); *E01F 9/688* (2016.02); *Y10T 29/49826* (2015.01)

(58) Field of Classification Search
CPC ..... E01F 9/688
USPC ..... 116/63 C; 359/553
See application file for complete search history.

(56) References Cited

U.S. PATENT DOCUMENTS 4,848,263 A * 7/1989 Grimm ..... 116/63 C
8,832,981 B2 * 9/2014 Desaulniers ..... B64D 25/20 116/209

FOREIGN PATENT DOCUMENTS

FR 2871482 A1 * 12/2005 ..... E01F 13/02
GB 2208124 A * 3/1989 ..... B60Q 7/00

OTHER PUBLICATIONS

English Translation of FR 2871482 A1.*

* cited by examiner

*Primary Examiner* — Daniel S Larkin
*Assistant Examiner* — Irving A Campbell
(74) *Attorney, Agent, or Firm* — Plager Schack LLP

(57) ABSTRACT

A safety cone is configured to reflect light in any orientation. The safety cone has a base attached to an upper portion. The base further comprises a base top side and a base bottom side. Reflective material attached in a plurality of locations on the base top side and the base bottom side. The reflective material is configured to reflect the light in any orientation.

6 Claims, 4 Drawing Sheets

SAFETY CONE AND METHOD OF MAKING THE SAME

RELATED APPLICATION

This application claims priority to provisional patent application U.S. Ser. No. 61/720,057 filed on Oct. 30, 2012, the entire contents of which is herein incorporated by reference.

BACKGROUND

The embodiments herein relate generally to safety cones and bollards.

Prior to embodiments of the disclosed invention, a user could not see a safety cone or ballard unless it was upright. This caused the upturned safety cone or ballard to become a hazard. Embodiments of the invention solve these problems.

SUMMARY

A safety cone is configured to reflect light in any orientation. The safety cone has a base attached to an upper portion. The base further comprises a base top side and a base bottom side. Reflective material attached in a plurality of locations on the base top side and the base bottom side. The reflective material is configured to reflect the light in any orientation.

In some embodiments, the base further comprises a plurality of base top side cavities and a plurality of base bottom side cavities both filled with the reflective material. The reflective material can be a liquid reflective material, a spray reflective material, or a reflective tape.

A process for making a safety cone configured to reflect light regardless of orientation includes the following steps, not necessarily in order. First, obtaining a safety cone further comprising a base attached to an upper portion. Next, applying reflective material to the safety cone such that the safety cone can reflect light regardless of orientation. In some embodiments, drilling a plurality of base top side cavities and a plurality of base bottom side cavities. The reflective material is applied within the plurality of base top side cavities and the plurality of base bottom side cavities.

BRIEF DESCRIPTION OF THE FIGURES

The detailed description of some embodiments of the invention is made below with reference to the accompanying figures, wherein like numerals represent corresponding parts of the figures.

DETAILED DESCRIPTION OF CERTAIN EMBODIMENTS

Figure 1:
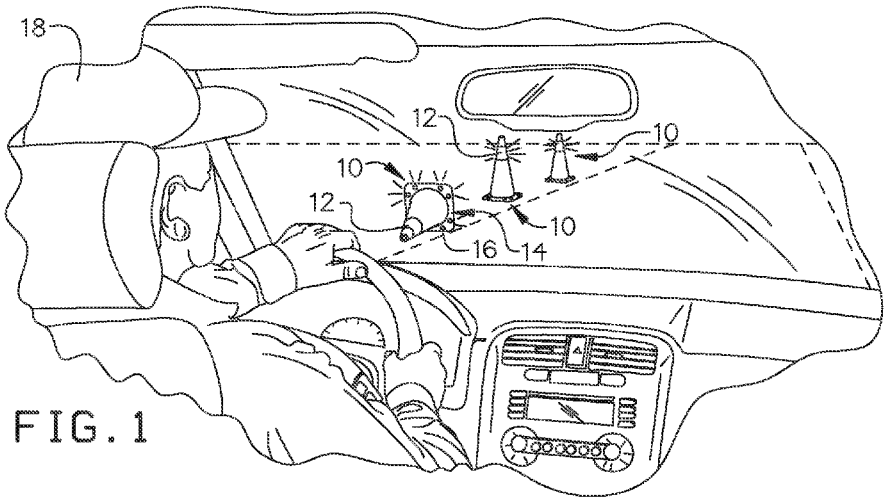
FIG. 1 is a perspective view of an embodiment of the invention shown in use.

By way of example, and referring to FIG. 1, one embodiment of safety cone 10 comprises a base having a base top side 14 and a base bottom side 20. attached to upper portion 12. Upper portion 12 has an upper reflective portion.

As used in this application "reflective material" can include luminescent material, that is, material which emits light. This includes photoluminescent material, that is luminescent material wherein the light emission is initiate by photoexitation. Reflective material can also include reflective paint, that is paint that contains thousands of little glass spheres, designed to reflect lots of light, even at night.

User 18 is shown driving a vehicle proximate a plurality of safety cones 10. One of the safety cones 10 has fallen over, yet user 18 can still see safety cone 10 even though the upper reflective portion is not reflecting light toward user 18.

Figure 2:
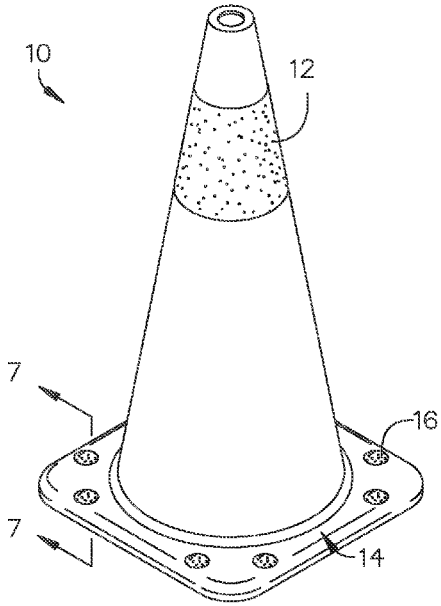
FIG. 2 is a top perspective view of an embodiment of the invention shown in use.
Figure 3:
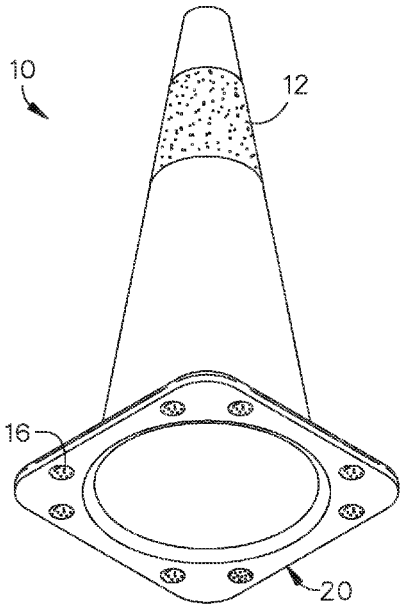
FIG. 3 is a bottom perspective view of an embodiment of the invention shown in use.
Figure 7:
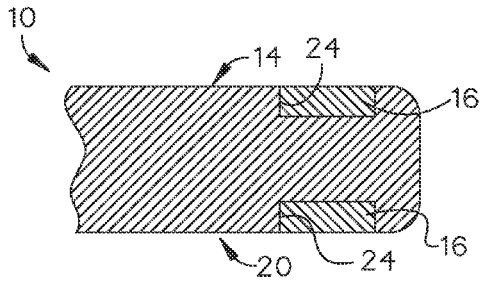
FIG. 7 is a section detail view of an embodiment of the invention along line 7-7 in FIG. 2.

FIG. 2, FIG. 3 and FIG. 7 show one theory of how to do this. Base top side 14 comprise base top side cavity 24. Base top side cavity 24 is filled with reflective material 16 and then permitted to harden as shown in more detail in FIG. 11. Base bottom side 20 comprise base bottom side cavity 24. Base bottom side cavity 24 is filled with reflective material 16 and then permitted to harden as shown in more detail in FIG. 11.

Figure 4:
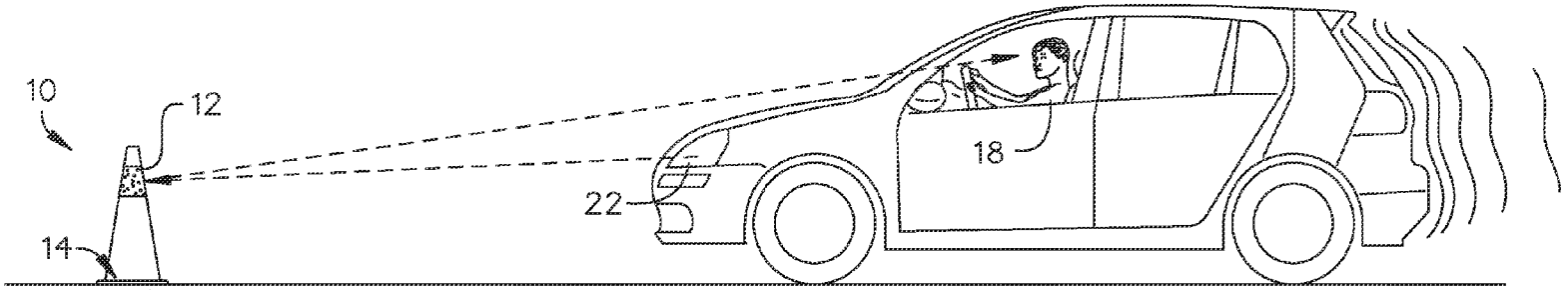
FIG. 4 is a side view of an embodiment of the invention shown in use.
Figure 5:
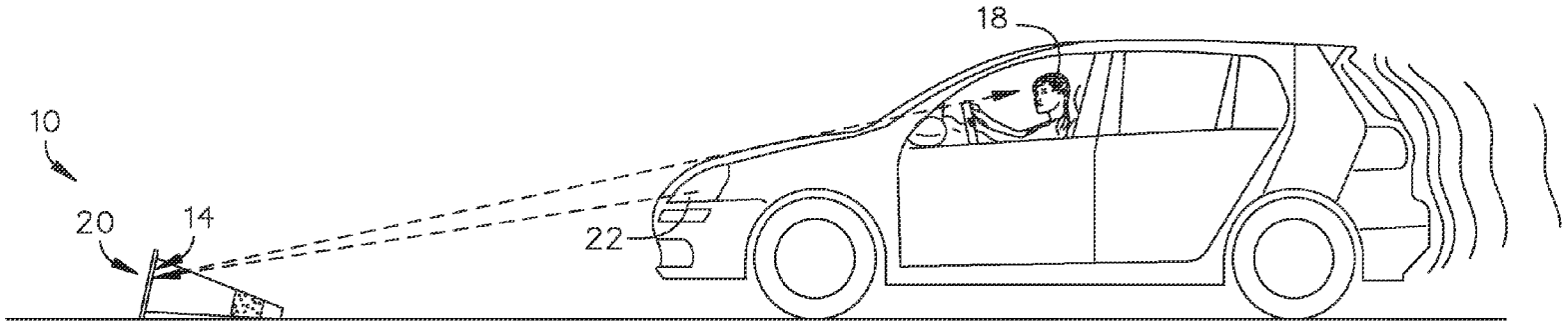
FIG. 5 is a side view of an embodiment of the invention shown in use in alternate configuration.
Figure 6:
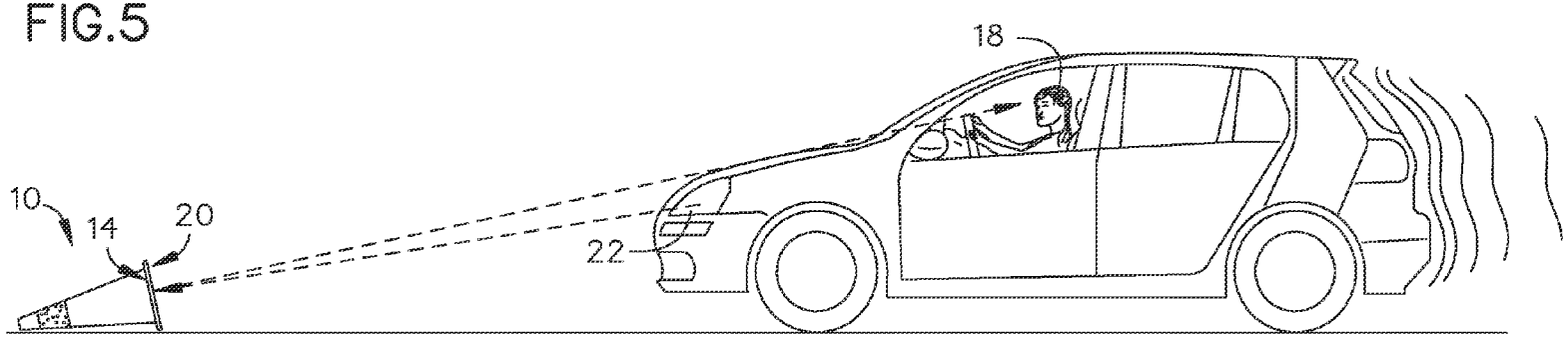
FIG. 6 is a side view of an embodiment of the invention shown in use in alternate configuration.

As shown in FIG. 4, FIG. 5 and FIG. 6, there can be a plurality of base top side cavities 24 and a plurality of base bottom side cavities 24 to accommodate reflective material such that safety cone 10 can be seen regardless of the orientation of safety cone 10 proximate user 18. One way to accomplish this is by having a pair of base top side cavities 24 and a pair of base bottom side cavities 24 proximate each corner of safety cone 10. Headlights 22 cause light to reflect off of reflective material 16 which is reflected upward toward user 18. Regardless, safety cone 10 should be able to reflect light in any orientation.

Figure 8:
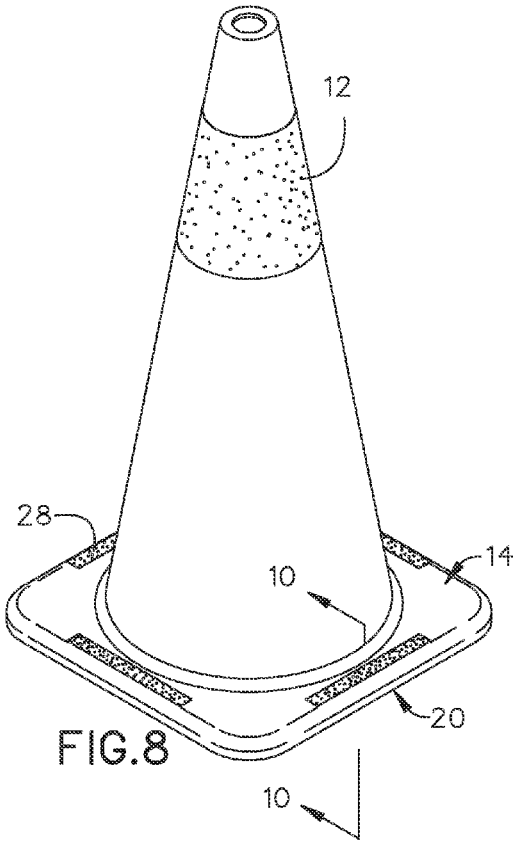
FIG. 8 is a top perspective view of an embodiment of the invention.
Figure 9:
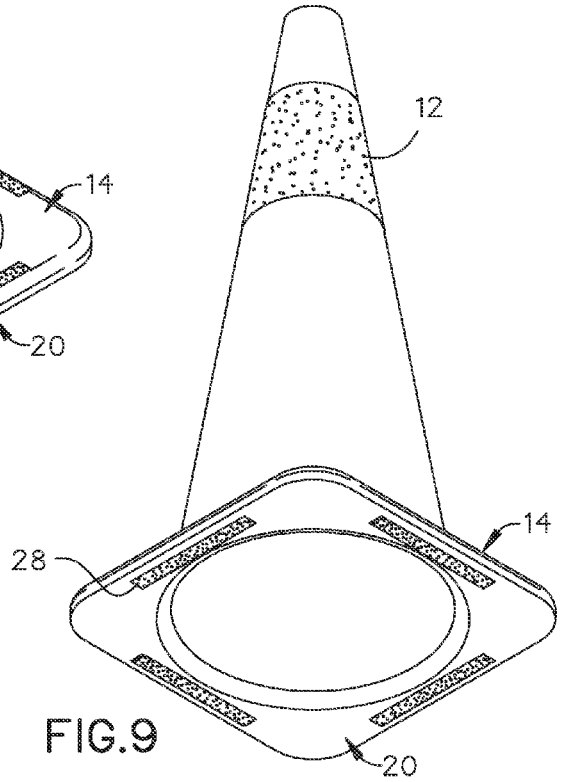
FIG. 9 is a bottom perspective view of an embodiment of the invention.
Figure 10:
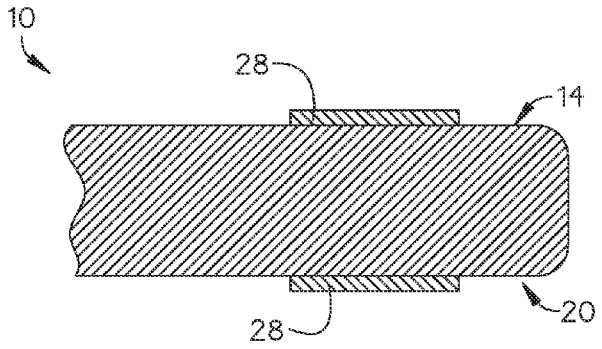
FIG. 10 is a section detail view of an embodiment of the invention along line 10-10 in FIG. 8.

Turning to FIG. 8, FIG. 9 and FIG. 10, here base top side 14 is connected to a plurality of base top side reflective tapes 28. Likewise, base bottom side 20 is attached to a plurality of base bottom side reflective tapes 28. Much like the cavities 24 described above, the plurality of base top side reflective tapes 28 and the plurality of base bottom side reflective tapes 28 should be configured to reflect light. One way to accomplish this is by having reflective tapes 28 placed between each corner on base top side 14 and base bottom side 20.

Figure 11:
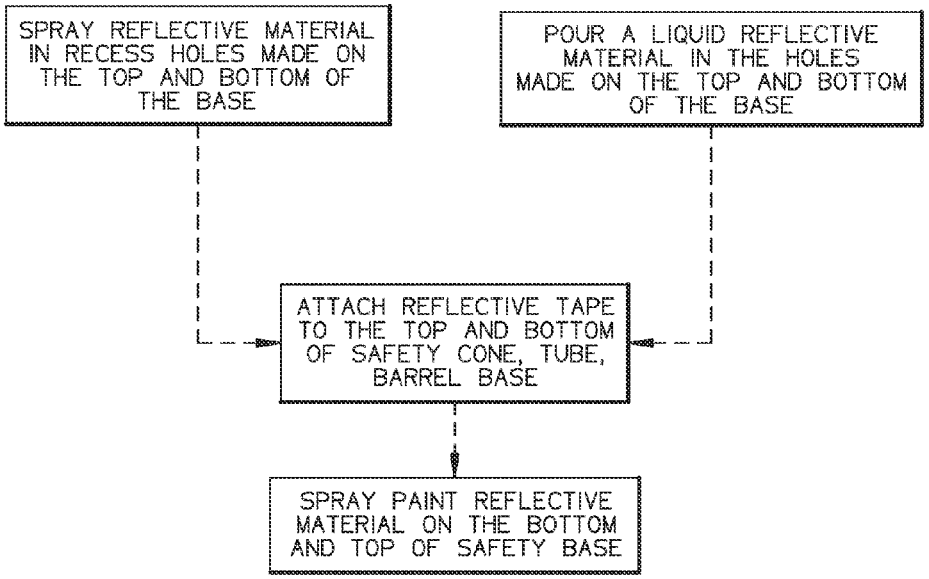
FIG. 11 is a schematic view of an embodiment of the invention.

FIG. 11 offers a set of theories on how to make safety cone 10. First, selecting an arrangement for reflective material. Next, applying reflective material to base top side 14 and base bottom side 14. This reflective material can be applied by drilling cavities 24 and filling cavities 24 with reflective material 16. The reflective material can either be a spray reflective material or a liquid reflective material that is permitted to harden.

In some embodiments, it may be effective to attach reflective tape to create the upper reflective portion on upper portion 12. In other embodiments, it may be effective to apply reflective spray paint on the top and bottom of the safety base. In other embodiments, a combination of these techniques can be effective. In other embodiments, the base can be dipped in reflective material.

Persons of ordinary skill in the art may appreciate that numerous design configurations may be possible to enjoy the functional benefits of the inventive systems. Thus, given the wide variety of configurations and arrangements of embodiments of the present invention the scope of the invention is reflected by the breadth of the claims below rather than narrowed by the embodiments described above.

What is claimed is:

1. A safety cone configured to reflect light in any orientation; the safety cone comprising:

a base further comprising four corners, attached to an upper portion; wherein the base further comprises a base top side and a base bottom side; wherein the base top side further comprises a plurality of base top side cavities and the base bottom side further comprises a plurality of base bottom side cavities; and reflective material filled into the plurality of base top side cavities until the reflective material is flush with the base top side; wherein the plurality of base top side cavities further comprising at least eight top side cavities; wherein two top side cavities are proximate each of the four corners;

additional reflective material filled into the plurality of base bottom side cavities until the reflective material is flush with the base bottom side; wherein the plurality of base bottom side cavities further comprising at least eight bottom side cavities; wherein two bottom side cavities are proximate each of the four corners;

wherein the reflective material is configured to reflect the light in any orientation.

2. The safety cone of claim 1, wherein the reflective material is a liquid reflective material.

3. The safety cone of claim 1, wherein the reflective material is a spray reflective material.

4. The safety cone of claim 1, wherein the reflective material is spray paint.

5. A process for making a safety cone configured to reflect light regardless of orientation; the process comprising:

obtaining a safety cone further comprising a base attached to an upper portion; wherein the base has a base top side and a base bottom side and four corners;

drilling a plurality of base top side cavities further comprising at least eight top side cavities; wherein two top side cavities are proximate each of the four corners and a plurality of base bottom side cavities further comprising at least eight bottom side cavities; wherein two bottom side cavities are proximate each of the four corners;

spraying reflective material into the plurality of base top side cavities and the plurality of base bottom side cavities;

filling the plurality of base top side cavities and the plurality of base bottom side cavities with the reflective material until the plurality of base top side cavities are filled to the base top side and the plurality of base bottom side cavities are filled to the base bottom side; wherein the safety cone such that the safety cone can reflect light regardless of orientation.

6. The process of claim 5, wherein the reflective material is applied by applying spray paint to the base top side and the base bottom side.

* * * * *